US005081963A

United States Patent [19]

Galbraith

[11] Patent Number: 5,081,963

[45] Date of Patent: Jan. 21, 1992

[54] RECIPROCATORY MACHINES

[75] Inventor: Peter A. Galbraith, West Midland, Australia

[73] Assignee: Galbraith Engineering Pty. Ltd., Australia

[21] Appl. No.: 684,155

[22] PCT Filed: Sep. 4, 1986

[86] PCT No.: PCT/AU86/00261

§ 371 Date: Mar. 24, 1989

§ 102(e) Date: Mar. 24, 1989

[87] PCT Pub. No.: WO88/01682

PCT Pub. Date: Mar. 10, 1988

Related U.S. Application Data

[63] Continuation of Ser. No. 337,764, Mar. 28, 1989, abandoned.

[51] Int. Cl.[5] ..... F02B 75/20

[52] U.S. Cl. ..... 123/59 AC; 123/65 VA; 123/188 C

[58] Field of Search ..... 123/42, 43 R, 44 C, 123/44 D, 59 AC, 65 VA, 65 VS, 80 C, 81 C, 188 C, 190 C, 65 BA, 51 B, 51 BA, 51 BD

[56] References Cited

U.S. PATENT DOCUMENTS

| | | | |
|---|---|---|---|
| 1,075,383 | 10/1913 | Rose | 123/188 C |
| 1,550,643 | 8/1925 | Bullington | 123/188 C |
| 1,664,056 | 3/1928 | Astrom | 123/190 C |
| 2,113,480 | 4/1938 | Kadenacy . | |
| 2,121,409 | 6/1938 | Ricardo | 123/65 VA |
| 2,197,107 | 4/1940 | Kammer | 123/65 VA |
| 2,242,871 | 5/1941 | Raab et al. | 123/81 C |
| 2,274,333 | 2/1942 | Kammer | 123/81 C |
| 2,403,865 | 7/1946 | Lebet | 123/81 C |
| 2,421,164 | 5/1947 | Senkowski | 123/81 C |
| 2,670,593 | 3/1954 | Bertin | 123/188 C |
| 2,691,970 | 10/1954 | Evans | 123/81 C |
| 2,714,879 | 8/1955 | Meulien et al. | 123/190 C |
| 2,781,748 | 2/1957 | Stucke | 123/190 C |
| 2,781,749 | 2/1957 | Stucke | 123/80 C |
| 3,844,109 | 10/1974 | Roos | 123/81 C |
| 4,767,287 | 8/1988 | Marks | 123/42 |
| 4,864,979 | 9/1989 | Eickmann | 123/65 BA |

FOREIGN PATENT DOCUMENTS

| | | |
|---|---|---|
| 24852/35 | 10/1935 | Australia . |
| 202816 | 7/1956 | Australia . |
| 616451 | 7/1935 | Fed. Rep. of Germany . |
| 1023618 | 4/1953 | France . |
| 57-102515 | 6/1982 | Japan . |
| WO86/06789 | 11/1986 | PCT Int'l Appl. . |
| 244155 | 4/1947 | Switzerland . |
| 497300 | 12/1938 | United Kingdom . |
| 563656 | 8/1944 | United Kingdom . |

*Primary Examiner*—David A. Okonsky
*Attorney, Agent, or Firm*—Sughrue, Mion, Zinn, Macpeak & Seas

[57] ABSTRACT

A reciprocatory machine having a cylinder defining with at least one piston a working chamber. Each piston is reciprocable in the cylinder by a respective crankshaft. The machine has intake and exhaust ports disposed at opposite ends of the working part of the cylinder and has respective valves additional to the pistons for opening and closing the ports. The valves are driven by the crankshaft(s) and have provision for adjusting the timing relationship between the displacement of the crankshaft(s) and the valves and thereby the timing relationship between the respective valves. The location of the ports at opposite ends of the working part of the cylinder permits considerably greater adjustment of the timing than is possible with conventional closely spaced porting arrangements. The machine preferably operates as a two-stroke internal combustion engine but may also operate as a pump or compressor.

15 Claims, 3 Drawing Sheets

RECIPROCATORY MACHINES

This is a continuation Ser. No. 07/337,764 filed Mar. 28, 1989, now abandoned.

This invention relates broadly to reciprocatory machines but provides, in a particular aspect, an internal combustion engine generally having a two-stroke cycle and adaptable to spark ignition or compression ignition.

Known internal combustion engines have proven very difficult to tune properly. Nevertheless, variable valve timing for conventional and other engines is well known and is generally performed by adjusting the rotational relationship between the crankshaft and the valve camshaft. Inbuilt provision for timing adjustment between the crankshaft and the valve camshaft has been proposed, for example, in British Patent Specification 2109858 which provides separate camshafts for the intake and exhaust valves and adjustment of the respective camshafts in a manner which is said to produce any desired change in the overlapping of the valve timing between the intake and exhaust valves.

In other cases where the ports are valved by respective opposed pistons, it has been proposed to provide for adjustment of the phase relationship between the pistons Such arrangements are suggested in German patent 616,451, in U.S. Pat. Nos. 2,113,480 and 2,401,188 and in British patent 584,783. In the latter case, a turbocharger is coupled to the intake port. In these engines, adjustment of the piston timing, for example in response to engine load, is marginally effective to vary the compression ratio and does inherently alter the valve timings but is clearly incapable of providing independent adjustment of valve timing. Moreover, altering the phase relationship between the pistons impairs or reduces the naturally very high level of dynamic balance within each cylinder that occurs when the crankshafts and pistons are in phase.

It is an object of the present invention to alleviate the aforementioned disadvantages of reciprocatory machines.

In accordance with the invention, the present invention has realized that difficulties experienced in achieving valve timing adjustment in internal combustion engines stem from the location of the intake and exhaust ports and/or associated valves and particularly from their close proximity in most conventional engines, especially four-stroke engines Thus, in most cases both the intake and exhaust ports are located in the cylinder head close to top dead center where space is at a premium and any adjustment other than minimal to the timing relationship between the piston and the valves may cause the piston and the valves to interfere, with consequent damage to the engine. If adjustment is possible to the timing relationship between the valves for the intake and outlet ports, the adjustment is also limited by the need to avoid interference between the valves.

The close proximity of the intake and outlet valves also leads to the possibility of reverse or spill flows of the inlet and exhaust gases occurring and any adjustment in the valve timing must be sufficiently small to avoid undesired reverse or spill flows.

The inventor has further appreciated that adjustment of the phase relationship between pistons also acting as valving means is an unsatisfactory device for achieving the real object - adjustment of the phase relationship between the valving means.

The present invention therefore provides a reciprocatory machine comprising means defining a working chamber, at least one piston reciprocable within the chamber, displaceable means associated with the piston or pistons and adapted to translate reciprocating movement of the piston or pistons into rotational movement or vice versa, intake and exhaust ports for the working chamber and respective valve means for said ports additional to said pistons, and wherein said intake and exhaust ports are disposed at or adjacent to respective ends of the working chamber and means is provided for adjusting the timing relationship between the displacement of the translating means and the valve means and thereby the timing relationship between the respective valve means.

Preferably the reciprocatory machine includes ignition means operable in the working chamber whereby the machine comprises an engine, preferably but not necessarily operable on a 2-stroke cycle. Alternatively the invention may be adapted to, for example, a compressor.

By the present invention it is possible to provide a substantially infinite variation of valve timing within a wide range by virtue of the spacing of the intake and outlet ports allowing for more precise control of the inlet and exhaust flows and, if desired, essentially a total elimination of reversed or spill flow of the inlet and/or exhaust gases. Furthermore, the separation of the valve means at or adjacent respective ends of the working chamber avoids the risk of their colliding, while the risk of collision between the piston and one of the valve means may be alleviated by providing only small or no adjustment of that valve means with the other valve means being fully adjustable or by using as said one valve means a type of valve with which collision is unlikely to occur, such as a sleeve valve. Generally however, the invention is applicable to various combinations of types of valve means, including sleeve valves, poppet valves and rotary distributor type valves, and preferably the intake and exhaust valve means are both adjustable for timing. Examples of engines in which the present invention may be readily used are the Detroit Diesel Engine having a poppet exhaust valve in the cylinder head and inlet ports in the cylinder wall near Bottom Dead Center, and the Ricardo sleeve valve engine.

Substantially infinite variation over a wide range of the valve timing may permit substantial variation of inlet timing, exhaust timing, effective compression ratio, effective expansion ratio, exhaust "blow down" period and supercharging period. This range of variation may permit a total change in character of the reciprocating machine from, for example, a racing car engine to a low horsepower engine for a road going family sedan. Advantageously the valve timing is adjustable during operation of the machine and by use of duplex cams, eccentrics and/or other suitable operating mechanisms, variation of timing may be effected not only continuously but within each cycle.

By the term "effective compression ratio" we mean the volume contained in the working chamber at the first moment at which the working chamber becomes sealed during a cycle divided by the minimum volume contained in the working chamber during the cycle, and by the term "effective expansion ratio" we mean the volume contained in the working chamber at the first moment at which the working chamber is opened to exhaust during a cycle divided by the minimum volume contained in the working chamber during the cycle.

One particular advantage of the invention, and in particular of the ability to finely control valve timing, is to render 2-stroke engines capable of optimum conjunction with a turbocharger. The benefits of turbocharging are well known and have been successfully obtained for some years with 4-stroke engines. However, it has generally been found very difficult to successfully apply turbocharging to 2-stroke engines, due largely to the typical conflict between the engine's general demand for inlet manifold pressure to rise as a cube function of speed and the turbocharger's quite different discharge pressure characteristic, and also due to a 2-stroke engine not being able to provide a positive naturally occurring inlet stroke such as normally occurs in a 4-stroke engine.

These problems are met by the invention. The provision for adjustment between the two valve means permits two notable temporary timing relationships, as follows:

(i) when a warm re-start is required, early opening of the exhaust valve will allow use of the pressure and/or thermal and/or kinetic energy of the hot residual gases within the cylinder to drive the turbocharger and so facilitate the refilling cycle.

(ii) for starts in general but especially cold starts, the valve timing can be adjusted to raise the compression ratio, lowering it again for subsequent running operation.

Generally the valve means will be driven by the translating means, which may comprise, for example, one or more crankshafts, and the drive means may comprise an internally toothed belt, commonly known as a timing belt, or a gear train, plus crank and pin or eccentric and follower mechanisms. In a preferred embodiment, the drive means to the or each adjustable valve includes a helical gear train and the adjusting means comprises means for varying the phase change across the gear train. The gear train for the or each adjustable valve may include respective helical gears on the translating means and on a drive shaft for the valve, and interposed helical gear means meshing with said helical gears, with the gear means being linearly movable parallel to the axes of the helical gears.

In the early years of internal combustion engines, poppet valving experienced difficulties with excessive noise and a tendency to induce both detonation and pre-ignition. An alternative was sleeve valving, which was used in a number of early commercial engines, particularly aero engines. The history of sleeve valve engines is well summarized in the standard text "The High-Speed Internal Combustion Engine" by Sir Harry Ricardo (published by Blackie & Son Limited, London) who himself built a number of successful long-life sleeve valve engines and carried out extensive research regarding their performance and optimum design.

Sleeve valve engines were found to have a number of significant advantages. Their mechanical efficiency and fuel consumption were impressive and in part arose from the unexpectedly low frictional losses at the interfaces between the reciprocating sleeve, typically a nitrided steel, and the cylinder barrel and piston. Provided the sleeve was reciprocated both longitudingly and circumferentially, there was excellent lubrication between the sleeve and the cylinder barrel. The Ricardo engines operated for many hours without any significant problems in the sleeve or piston motion. The engines were quiet and it was found that the piston temperature in a liquid-cooled sleeve valve engine was actually a little lower than in a poppet valve engine of similar capacity and output, apparently because the moving oil film between the sleeve and cylinder wall was a very efficient convector of heat away from the piston. Because the cylinder head was unencumbered by ports and valves, one had complete freedom as regards the form or capacity of the combustion chamber.

These advantages were especially applicable to 2-stroke engines, but there were also found to be some significant disadvantages which mitigated against the widespread commercial application of 2-stroke sleeve valve engines, particularly given that the major objectionable features of early poppet valve engines had later been resolved. Ricardo saw two significant difficulties which he summarized at page 387 of his text (cited above):

> "1. The nitrided sleeves have a life of probably 2000 to 4000 hours before wear of the top end of the sleeve renders them unservicable. This is long enough for military aircraft, but not nearly long enough for ordinary commercial duties. Some means will yet have to be found for reducing the rate of wear in this zone.""2. Although the open-ended sleeve appears to seal perfectly under all operating conditions, it does not provide a complete seal when starting from cold, and some means, such as the injection of a little thick oil, must be applied to enable the compression ignition version to start from cold: this is rather an objectionable feature."

The wear of the top end of the sleeve arose from exposure of this part of the sleeve to the full flow of exhaust gases and/or mechanical interference with the upper part of the cylinder barrel or head. Secondary disadvantages of the sleeve valve engine were the bulky and expensive re-entrant head, known as a junk-head, which gave rise to wasteful heat losses and, in air cooled applications, was difficult to adequately cool.

In the case of 4-stroke sleeve valve engines, the two problems noted by Ricardo did not apply but the presence of the junkhead was still a significant obstacle to commercial development.

One solution to those problems not appreciated even by Ricardo but disclosed in British Patent Specification 497,300 to Porkman, and in British patent 1,015,189 to Lindsay, was to adapt the fundamentals of sleeve valving to an opposed piston engine, that is to provide a pair of opposed pistons with respective sleeves providing valves for the exhaust and intake ports. There were a considerable number of successful and commercial opposed piston engines, of which typical examples are Junkers Jumo, Rootes Diesel and Napier Deltic engines but all relied upon piston controlled valving. So far as the applicant is aware, an opposed piston engine of Porkman's or Lindsay's design was never commercialized and sleeve valved engines have remained only an historical curiosity since the end of World War II despite their advantages as noted by Ricardo. It is believed that the present invention will encourage those advantages to be realized, both in non-opposed and opposed piston form.

Referring now particularly to a sleeve valved engine, the or each sleeve is preferably driven in a reciprocatory motion which is both circumferential and longitudinal. The stroke of the circumferential motion is preferably at least 20% of the stroke of the longitudinal motion.

In the case of two opposed pistons in the working chamber, and sleeve valving in the form of respective sleeve valves for the spaced exhaust and intake ports, the separate sleeves are advantageously reciprocable about the respective pistons. Preferably, respective crankshafts are provided for the two pistons, and the sleeves are reciprocable by separate drive means from the respective crankshafts. The crankshafts are preferably directly coupled by an internally toothed belt, and the drive shaft to the load is preferably parallel or coaxially coupled to one or both of the crankshafts.

The intake port is advantageously coupled to a supercharger, and most advantageously to a turbocharger mounted to be driven by products from the exhaust port.

Two embodiments of the invention will be further described, by way of example only, with reference to the accompanying drawings, in which.

Figure 1:
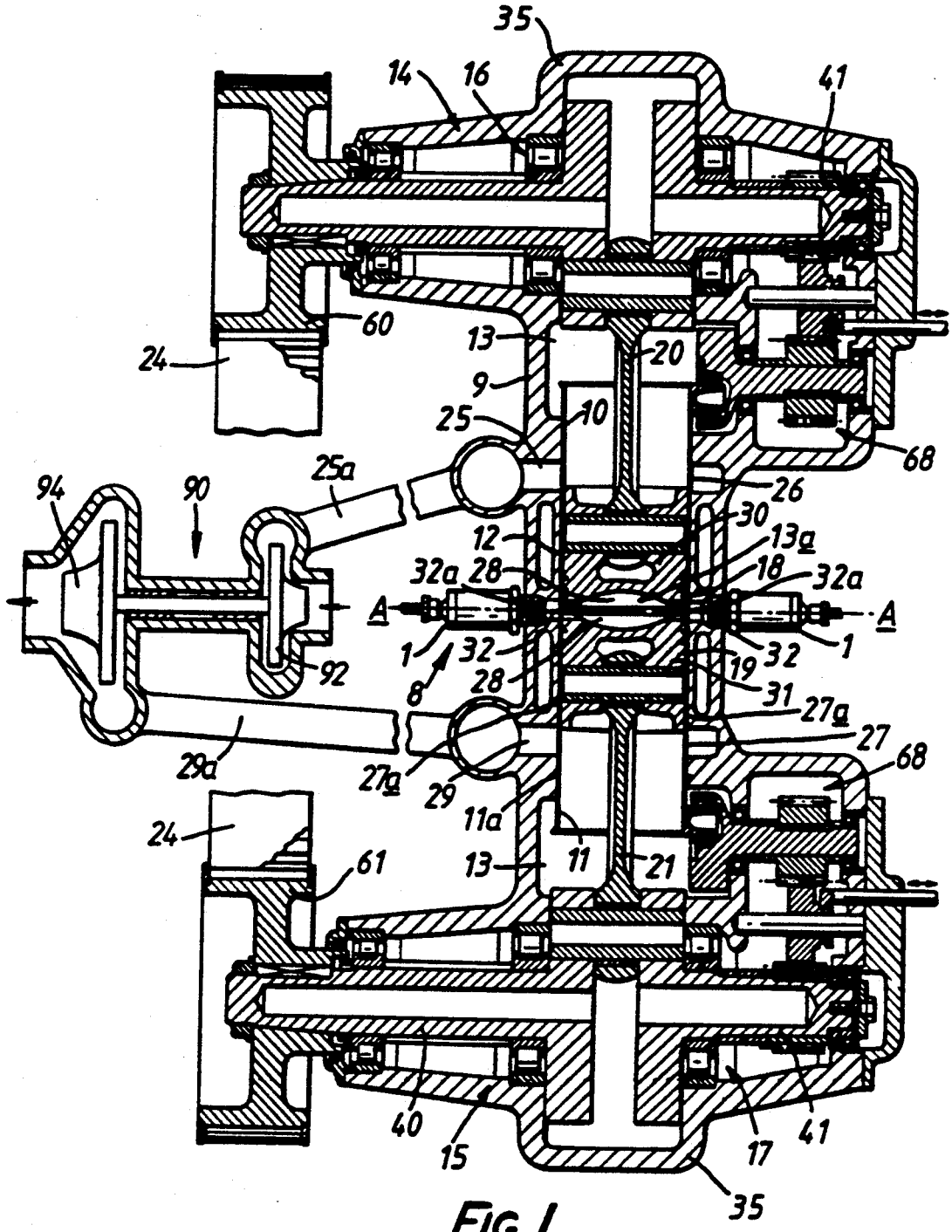
FIG. 1 is a multi axial somewhat diagrammatic cross-section of a 2-stroke opposed piston sleeve valved engine in accordance with the invention, with the pistons shown close to top dead center.
Figure 2:
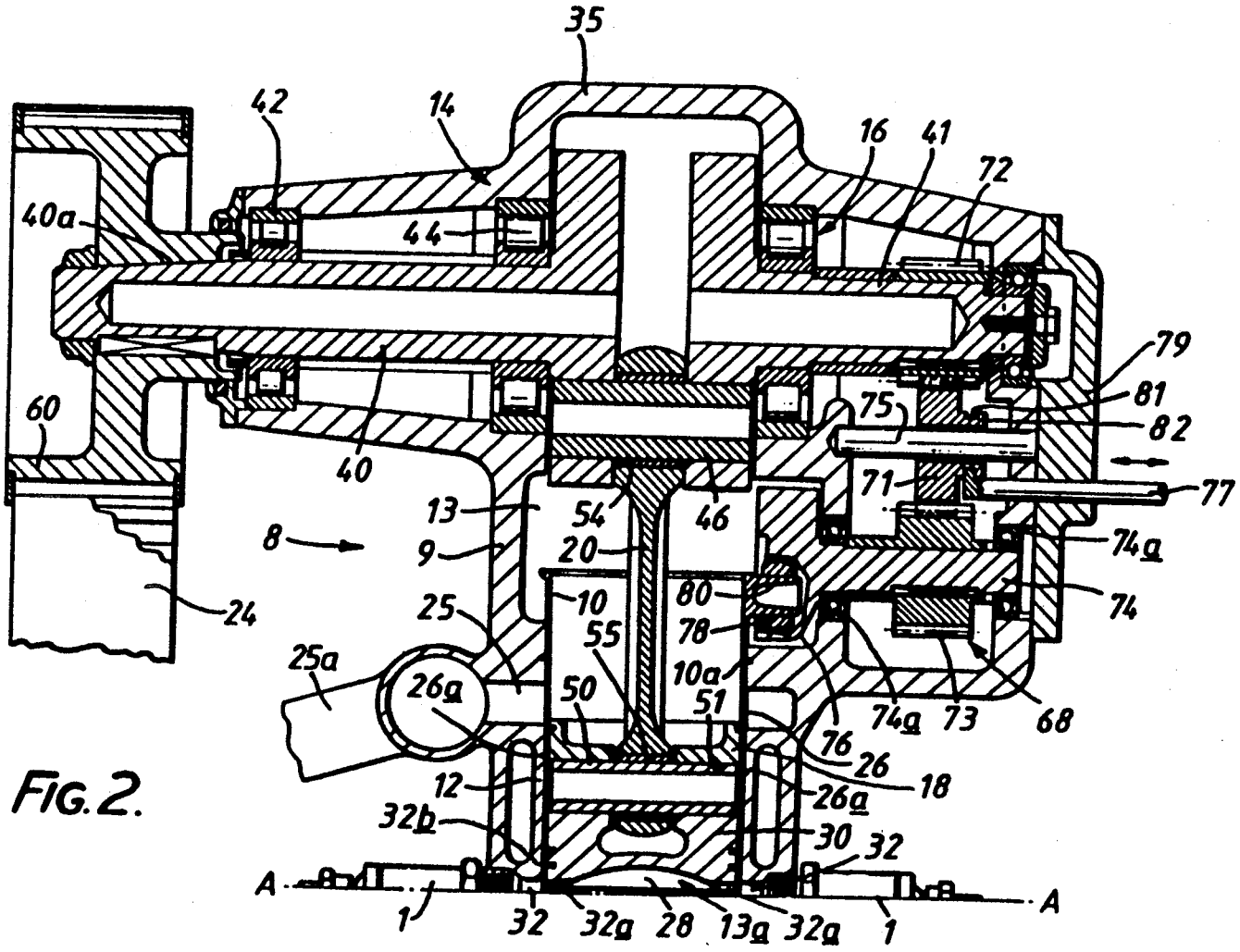
FIG. 2 is an enlargement of one end of the engine of FIG. 1.

Referring to FIGS. 1 and 2, the illustrated opposed piston 2-stroke engine 8 is substantially symmetrical about a transverse median plane A-A and includes a cast engine block 9 which encompasses a cylindrical barrel 12, defining a working chamber and crankcases 14, 15 with cover portions 35. The engine further includes respective crankshaft assemblies 16, 17, and a pair of opposed pistons 18, 19 coupled to the crankshaft assemblies 16, 17 by connecting rods 20, 21 for opposite reciprocation within the working chamber timed by an internally toothed belt 24. Barrel 12 and crankcase assemblies 14, 15 are shown for convenience as a single casting but this may be varied according to circumstances. FIG. 1 illustrates the crankshafts in phase and the pistons at top dead center, inwardly of respective rings of ports 26, 27 in cylinder barrel 12. The crankshafts may of course be set out of phase as desired, for example to achieve improved air scavenging in two-stroke mode. Ports 26, 27 open to respective annular manifolds 25, 29, which in operation comprise an intake manifold and an exhaust manifold, and which communicate in turn with ducts 25*a*, 29*a*. The exact physical structure of the manifolds and associated ducts is not detailed, being indicated schematically only in FIG. 1. Intake duct 25*a* is coupled to the outlet of a turbocharger assembly 90 including a blower 92 driven by a turbine 94. Turbine 94 is in turn powered by exhaust gases directed along duct 29*a*.

The combustion chamber 13*a* substantially comprises a pair of radiused cavities 28 in the heads 30, 31 of pistons 18, 19. As shown the cavities 28 are spherically radiused, but in alternative configurations the piston heads, or discrete crowns if desired, may be flat or convex. For spark ignition and/or injection access to the combustion chamber, cylinder barrel 12 is provided with peripherally spaced ignition ports 32, and piston heads 30, 31 with registering grooves 32*a*. Injection devices 1,1 for compression ignition are illustrated in this case but it is emphasized that spark plugs may be substituted as desired.

The crankcase and crankshaft assemblies are substantially identical and it is therefore proposed to describe in detail only those at the upper end of the engine as seen in FIG. 1. This end is enlarged in FIG. 2. Crankshaft assembly 16 includes a pair of co-axial crankshafts, a drive crankshaft 40 and a timing crankshaft 41. The two are supported in crankcase 14 and crankcase covers 35 by spaced roller bearings 42, 44. The crankshaft assembly is coupled to the piston in a substantially conventional arrangement including a tubular crankpin 46, a gudgeon pin 50 retained in a matching or transverse bore 51 in piston 18, and connecting rod 20 which receives crankpin 46 and gudgeon pin 50 within respective roller cages 54, 55.

The two timing crankshafts 41 are keyed through crankshafts 40 to respective pulleys 60, 61 (FIG. 1) for timing belt 24. A tapered mounting is used as illustrated at 40*a* not only for the usual reason of ensuring a secure mounting but in this case also to permit tensioning of the timing belt in the absence of any idler pulley for such purpose.

Cylinder barrel 12 is fitted with a pair of similar elongate sleeve valves 10, 11 which, by virtue of spaced rings of apertures 26*a*, 27*a*, in the sleeves, provide valving for ports 26, 27 and are reciprocable about the respective pistons 18, 19. Sleeves 10, 11 may be formed in cast iron, nitrided steel or other suitable materials such as ceramics or high performance plastics. They make a good tolerance fit within the cylinder barrel and are each free to reciprocate both longitudinally and circumferentially. O-ring seals are provided where shown, for example at 10*a*, 11*a* on the intermediate walls of the cylinder barrel and on the cylindrical surfaces of the pistons In operation, a thin film of oil is supplied and maintained between the sleeves and the barrel and it is for the purpose of maintaining proper distribution of this film that the circumferential component of the oscillation is primarily necessary.

Sleeves 10, 11 are reciprocable from the respective crankshafts 40 by means of separate helical gear trains 68 which are substantially identical and which are fitted with means for adjusting the timing relationship or phase between the respective pistons and the valving of the associated ports by the sleeves, and thereby the timing relationship between the sleeves in accordance with the present invention. Each gear train 68 comprises respective helical gears 72, 73 on crankshaft 41 and on a crank 74. These gears mesh with an intermediate helical gear 71 which is both slidably and rotatably mounted on an interposed stud 75. As the illustrated engine is configured for 2-stroke operation, gears 72, 73 are in 1:1 ratio.

Crank 74 is supported in roller bearings 74*a* and has a socket 76 housing a spherical bearing 78 for a spigot 80 projecting laterally integrally from the sleeve 10. It will be appreciated that this arrangement achieves the required two component motion: the motion is optimised for lubrication purposes, as described above, if the stroke of the circumferential component of the reciprocatory motion is at least 20% of the stroke of the longitudinal component.

Phase adjustment is achieved by way of a slidable push-pull rod 77 which seats in an annular groove 81 of a boss 82 on intermediate gear 71. Rod 77 slidably projects through a gear case cover 79: slight movement of gear 71 along stud 75 will itself cause relative rotation of the gears, because they are helical gears, and thus an alteration of the phase between crankshaft 40 and crank 74. This in turn will vary the timing relationships mentioned above. This arrangement permits infinite timing phase adjustment over a 180° range.

Instead of driving each sleeve via a crank 74, a camshaft may be employed. This affords the additional advantage that the timing relationship(s) may be varied, not only by adjusting rod 77, but also, by utilizing a cam of selected shape, within each stroke of the engine.

Rod 77 may be arranged for manual control, or for automatic control in response to, e.g., the monitoring of intake manifold pressure, engine speed, road speed, throttle setting and torque output.

Sleeves 10, 11 are provided with complementary scallops 32*b*, which register at the required times with injection ports 32 and piston grooves 32*a*. Apertures 26*a*, 27*a* in the sleeves co-operate as required with barrel ports 26, 27. It is not thought necessary to provide any specific detail regarding the port configuration as it will depend, inter alia, on the mode of operating the engine and on the air flow and the range of phasing characteristics desired. Considerations in relation to timing adjustments under different engine load conditions are also well known as provision of such adjustments is a known art.

An important preferred feature of the engine disclosed in FIGS. 1 and 2 which facilitates smooth and trouble-free operation is the use of timing belt 24 as a direct drive coupling between the crankshafts. Most advantageously for the particular application, this belt is preferably an advanced belt of the HTD design marketed by the UniRoyal Company. Such belts would also advantageously be employed to couple the output shaft to load.

It will be appreciated that the engine illustrated in FIGS. 1 and 2 may include other modifications or adaptations in accordance with the mode in which it is operated and with standard principles of engine design. For example, other forms of supercharging, e.g. Kadency and/or conventional, positive displacement and/or mechanically driven centrifugal superchargers may be employed. Established sleeve valve porting principles can be applied to take advantage of the porting in both barrel and sleeve, of the two component motion of the sleeve, and of the lack of direct contact between the piston rings and the barrel ports.

It will further be seen that both of the primary objections of 2-stroke sleeved valve engines noted by Ricardo and quoted above are overcome: there is no longer any relatively short-term wear of the sleeve ends due to exposure to full flow of exhaust gases and there is no longer any problem with lack of sealing at an open-ended sleeve when starting from cold. The outer sleeve ends of the engine of FIGS. 1 and 2 lie in the crankcases and the inner ends are surrounded by the cylinder barrel and are thereby neither exposed to flow of exhaust gases nor in need of sealing at start-up. This also allows full advantage to be taken of one of the useful features of sleeve valve engines, the self compensating relationship between the size of the sleeve to barrel gap and the rate of heat transferred across the gap. For example, when the tolerance is substantial, heat transfer from the piston through the oil film is retarded which results in thermal expansion of the sleeve to reduce the gap until a balance occurs between the rate of heat dissipation across the film and the thermally determined diameter of the sleeve.

Elimination of the junkhead means elimination of an expensive, high heat loss component and, moreover, of a component which was difficult to air cool because of its substantial re-entrant bulk. In this latter respect, it is interesting to note the very expensive and detailed composite copper cooled head produced by the Bristol Aeroplane Company to resolve the problem of air cooling the junk head.

By adapting the opposed piston configuration to sleeve valving in the engine of FIGS. 1 and 2 it has been possible to not only overcome outstanding objections to sleeve valve engines, but to obtain for opposed piston engines the significant known advantages of sleeve valving. In particular, the mechanical efficiency and fuel consumption are substantially improved relative to prior opposed piston engines, and the weight to power ratio is markedly enhanced. Thus, one of the objections to opposed piston engines in certain key applications, their somewhat troublesome dimensional configuration, can be overcome in that the opposed piston engine can be reduced to a very compact size for a given power output.

The ability to selectively vary the timing relationship between each sleeve and the associated piston, makes it possible to obtain infinite variation over wide ranges of effective compression ratio, effective expansion ratio, timing, and volume of the working space. These variations are not merely possible from cycle to cycle but within each cycle, allowing the control system to be promptly responsive to changes in the engine's load requirements. This flexibility is valuable in particular for 2-stroke operation and is to be contrasted with the fixed compromise timing settings in most conventional engines. The engine can work and be matched to a variable torque load via a simple transmission: the modern practice to achieve optimum efficiency load matching by way of a continuously variable torque transmission may be largely superseded by the utilization of the engine itself. The provision of spaced intake and exhaust valves 26 and 27 in the engine has further advantages. For one, it renders practical the avoidance of reverse or spill flow when varying the effective compression ratio and/or effective expansion ratio. This is not possible with either an opposed piston engine with conventional valving or the modern poppet valve engine.

Variation of the valve timing in accordance with the invention permits a most versatile turbocharged 2-stroke engine. Conventional 2-stroke engines are not well-suited to supercharging in general and even less so to turbocharging. Even where turbocharging has been provided, it has not been possible to rely on the turbocharger to adequately provide inlet air to the engine under starting conditions or for significant parts of the engine's load speed curve and a separate mechanical supercharger has been required to overcome these deficiencies.

In cases where turbocharging of 2-stroke diesel engines has been attempted, a separate external mechanical blower has been required for starting purposes.

The inventive engine, in contrast, permits turbocharging of a 2-stroke engine under the full range of operating conditions and eliminates the need for a separate mechanical supercharger. For example when a warm re-start is required, early opening of the exhaust valve will allow use of the pressure and/or thermal and/or kinetic energy of the hot residual gases within the cylinder to drive the turbocharger and so facilitate the refilling cycle. For starts in general but especially cold starts, the valve timing can be adjusted to raise the compression ratio, lowering it again for subsequent running operation. Under all load conditions, it is possible to vary the inlet and/or exhaust timing so as to overcome the inherent incompatability of the engine's air demand characteristics and the turbocharger's output characteristics, and to generally tune or modify the engine's characteristics to the prevailing requirements.

The ability to vary the volume of the working space, a consequence of the invention already noted, allows the engine to be run for more of the time at a brake mean effective pressure which provides high thermal efficiency. In other words, the engine output is then significantly controlled by modifying its volume rather than its brake mean effective pressure away from an efficient condition.

It will be noted that the described arrangement affords near perfect primary and secondary balance within each cylinder. In contrast, as previously mentioned, the known practice of altering the phase relationship between the pistons in an attempt to alter compression ratio, impairs this very high level of dynamic balance.

Figure 3:
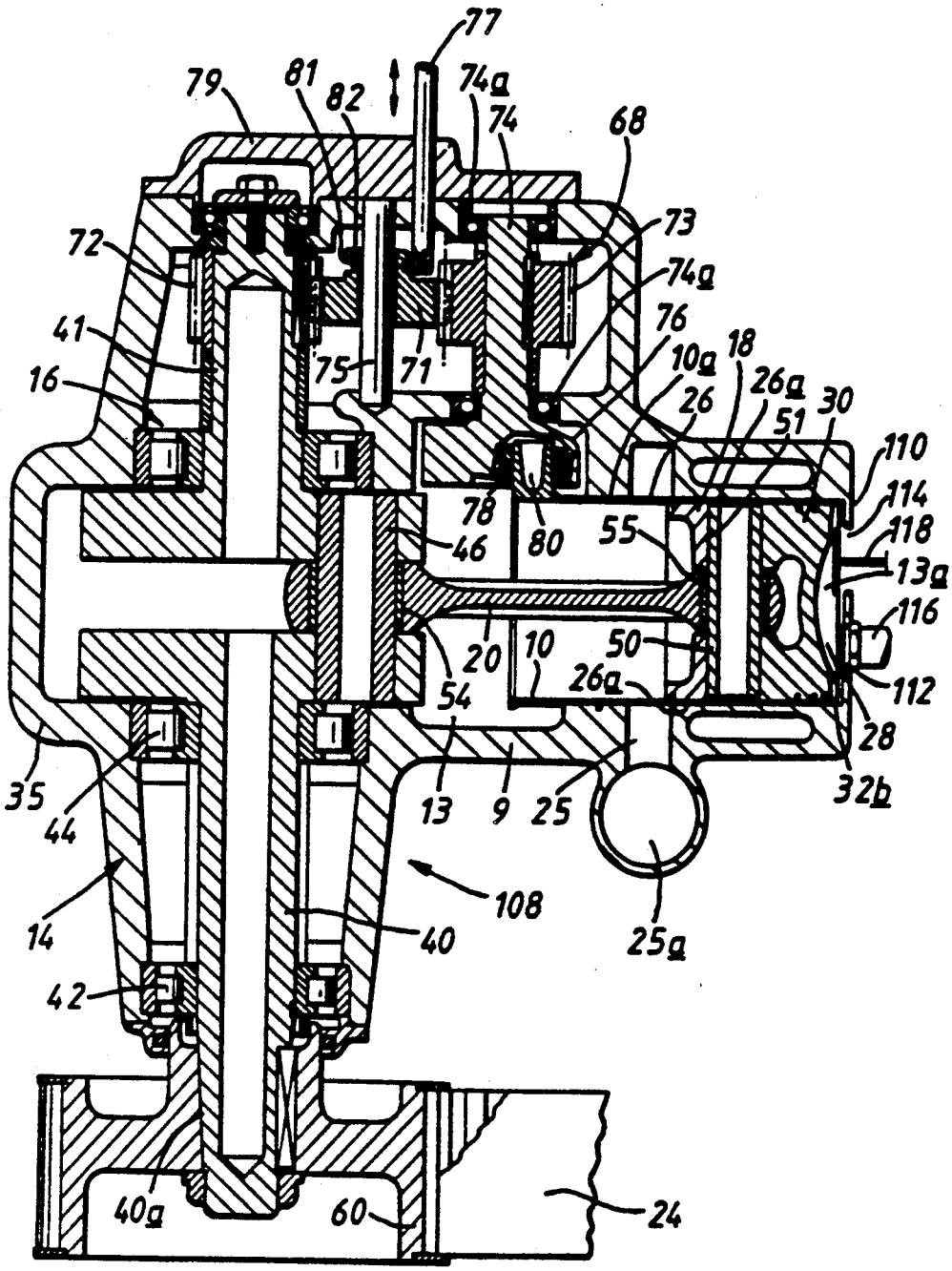
FIG. 3 is a view similar to FIG. 2 but showing the one end of the engine modified to operate alone.

FIG. 3 illustrates the half engine of FIG. 2 modified to operate alone and since the operation of the engine 108 is substantially identical to the operation of the half engine in FIG. 2 its manner of operation will not be described again except in relation to its differences.

The engine block 9 in FIG. 3 is modified to define a combustion head 110 with apertures 112 and 114 therein to receive an injector or sparking plug illustrated schematically at 116 and a poppet valve 118. The poppet valve is also illustrated schematically in the open position but may take any of a number of known forms which are not believed to require detailed description. Furthermore the drive mechanism for the poppet valve 118 is not illustrated and may be non-adjustable in accordance with generally standard engine practice. Alternatively, the poppet valve 118 is preferably adjustable as to its timing and such adjustability may be provided by for example the means illustrated in British Patent Specification 2109858. Alternatively, the adjustment means described herein for use with the sleeve valve 10 may be duplicated and adapted to the drive means for the poppet valve. Thus the crank 74 may be connected via a gear train or belt to a camshaft having an eccentric for displacing the poppet valve against the bias of a spring. Adjustment of the helical gear 71 may change the phase of the poppet valve.

Other modifications, alterations and advantages applicable to the engine described with reference to FIGS. 1 and 2 may be applied to the engine 108.

Although the invention has been described with reference to an internal combustion engine, the principles of the invention are also applicable to other forms of reciprocatory machines such as pumps or compressors.

I claim:

1. A reciprocatory machine adaptable as a 2-stroke engine comprising means defining a working chamber, at least one piston reciprocable within the chamber, displaceable translating means associated with the piston and adapted to translate reciprocating motion of the piston into rotational movement or vice versa, intake and exhaust ports for the working chamber and respective intake and exhaust valve means for said ports distinct from said at least one piston, and means for causing said respective valve means to cyclically operate in response to said reciprocating motion of the piston, wherein at least one of the valve means comprises a sleeve valve reciprocable within said working chamber about said at least one piston and wherein said intake and exhaust ports are disposed at or adjacent to opposite ends of the working chamber respectively and means are provided for effecting independent adjustment of the timing relationship between the cyclic operation of each of the intake and exhaust valve means and the displacement of the translating means including independent adjustment of the timing of both opening and closing of each of the intake and exhaust valve means, and thereby to adjust the timing relationship between the cyclic operation of the respective valve means.

2. A reciprocatory machine according to claim 1 wherein the valve means for the intake and outlet ports are driven by respective drive means including a helical gear train and said adjusting means comprises means for varying the phase angle across the gear train.

3. A reciprocatory machine according to claim 2 wherein said gear train for each valve means includes respective helical gears on the displaceable means for the or each piston and on a drive shaft for the valve means, and interposed helical gear means meshing with said helical gears, said gear means being linearly moveable parallel to the axes of said helical gears.

4. A reciprocatory machine according to claim 1, 2 or 3 wherein said intake port is coupled to receive gas from supercharging means.

5. A reciprocatory machine according to claim 4 wherein said supercharging means is mounted to be driven by gases from said exhaust port and thereby comprises turbocharging means.

6. A reciprocatory machine according to claim 1 wherein at least one of the valve means comprises a sleeve valve.

7. A reciprocatory machine according to claim 6 which comprises a pair of opposed pistons reciprocable within the working chamber and the valve means comprises two separate sleeve valves reciprocable about the pistons.

8. A reciprocatory machine according to claim 7 wherein said separate sleeve valves are reciprocable about the respective said pistons.

9. A reciprocatory machine according to claim 8 further comprising respective displaceable means for the two pistons, and wherein the sleeve valves are reciprocable by separate drive means from the respective displaceable means.

10. A reciprocatory machine according to claim 7 wherein said displaceable means are directly drivingly coupled by an internally toothed belt.

11. A reciprocatory machine according to claim 1 wherein the displaceable means comprises one or more crankshafts.

12. A reciprocatory machine according to claim 7 wherein the sleeve valves are arranged to reciprocate both longitudinally and circumferentially.

13. A reciprocatory machine according to claim 12 wherein the stroke of circumferential reciprocatory motion of each sleeve valve is at least 20% of the stroke of the longitudinal reciprocatory motion.

14. A reciprocatory machine according to claim 1 further including ignition means operable in said working chamber whereby the machine comprises an engine.

15. A reciprocatory machine according to claim 14 configured for 2-stroke operation.

* * * * *